US006033372A

United States Patent [19]

Tarbet et al.

[11] Patent Number: 6,033,372

[45] Date of Patent: Mar. 7, 2000

[54] HAND HELD MASSAGING DEVICE WITH BIASED ROLLERS

[75] Inventors: John Alexander Tarbet, Pt. Reyes Sta.; Kenneth Tarlow, Corte Madera, both of Calif.

[73] Assignee: John Tarbet, San Francisco, Calif.

[21] Appl. No.: 08/838,577

[22] Filed: Apr. 10, 1997

[51] Int. Cl.[7] ..... A61H 15/00

[52] U.S. Cl. ..... 601/123; 601/125; 601/133

[58] Field of Search ..... 601/115, 118, 601/119, 122.5, 128, 131, 132, 135, 137, 133; 606/204

[56] References Cited

U.S. PATENT DOCUMENTS

| | | | |
|---|---|---|---|
| 2,230,890 | 2/1941 | McClenathen | 601/122 |
| 3,583,396 | 6/1971 | Landis | 601/125 |
| 3,759,250 | 9/1973 | Salata | 601/122 |

FOREIGN PATENT DOCUMENTS

| | | | |
|---|---|---|---|
| 814881 | 7/1937 | France | 601/132 |
| 237500 | 9/1945 | Switzerland | 601/132 |
| 1528489 | 12/1989 | U.S.S.R. | 601/122 |

*Primary Examiner*—Danton D. DeMille

[57] ABSTRACT

A non-electric hand held massaging device for massaging a persons hands, arms, feet and legs. The device consists of a pair of opposed rigid rollers, each with a plurality of resilient protrusions radiating outwardly from the surface the rollers. The rollers terminate in shafts which are held in tracks located on either side of the rollers. A circular handle surrounds the tracks and rollers making it convenient for a user to hold the device in a variety of positions. A pair of elastic cords is located in the hollow space formed inside the track portion and the handle portion. The elastic cords terminate in shaft holders which connect to the shaft ends of the rollers. The elastic cords are placed in such a way as to create a spring tension between the two rollers so that when a user inserts his or her hand or foot between the rollers, he or she receives an invigorating massage caused by the action of the many resilient tips of the roller surface impinging of the users skin. A removable cover located on the top of the track and handle same allows the user to adjust the spring tension and to remove and replace the rollers.

2 Claims, 5 Drawing Sheets

HAND HELD MASSAGING DEVICE WITH BIASED ROLLERS

FIELD OF INVENTION

The present invention relates to massaging devices and more specifically to a non-electric hand held massaging device for use in massaging a users hands and arms as well as feet and legs.

BACKGROUND OF THE INVENTION

Non-electric hand held massaging devices have been available in the marketplace for many years. Many of the devices involve rollers which have bumps or other types of raised areas radially placed about the perimeter surface of the roller. The user positions the roller portion over a selected area of his or her body and initiates a rolling action thereby causing a massaging effect in that area. A drawback with these types of rollers is that they rely on the strength of the user to press the roller portion onto the body area to be massaged. Another drawback is that the bumps or other raised portions on the roller do not significantly act to increase blood flow in the area being massaged. Additionally, the existing massage rollers either have no handle or have a handle oriented in only one direction making it difficult to use when massaging a variety of body parts.

OBJECTIVES AND SUMMARY OF THE PRESENT INVENTION

It is an objective of the present invention to overcome the above stated limitations of the existing art as well as add additional features making the art of non-electric hand held massage more convenient and efficient. To this end the present invention consists of a pair of opposed rollers held together by spring tension. The ends of the shafts of the rollers slide in tracks thereby allowing the rollers to be separated in a linear fashion. When a user inserts his or her hand or foot into the space between the rollers, the hand and arm or foot and leg is massaged by a multitude of resilient plastic or rubber members radiating from the surface of both rollers thereby simultaneously receiving a stimulating massage on the upper and lower surfaces of the body part being massaged. The spring tension between the rollers may be adjusted by the user to give a light or deeper massage. A circular handle surrounds the rollers and track assembly thereby giving the user a variety of positions with which to hold the massager of the present invention. The massager of the present invention may be held by one hand when a user is massaging his or her other hand and arm, or held by two hands when a user is massaging his or her legs and feet or when a second person is giving a massage to a person being massaged. In this way the present invention provides an improved, non-electric, hand held massaging device for massaging a persons hands and arms as well as feet and legs.

GENERAL DESCRIPTION OF THE DRAWINGS

DETAILED DESCRIPTION OF THE DRAWINGS

Figure 1:
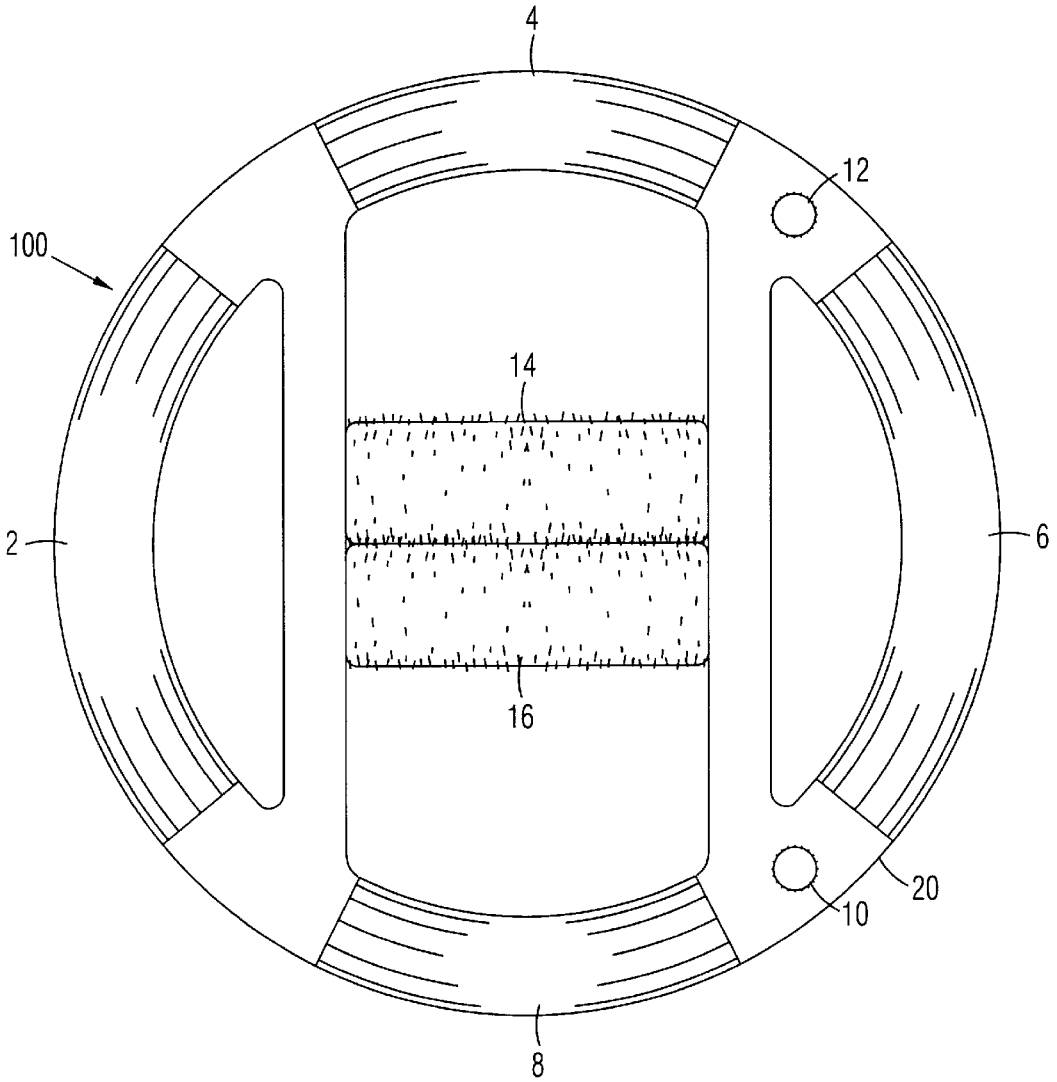
FIG. 1 is a plan view of the hand held massager of the present invention.
Figure 2:
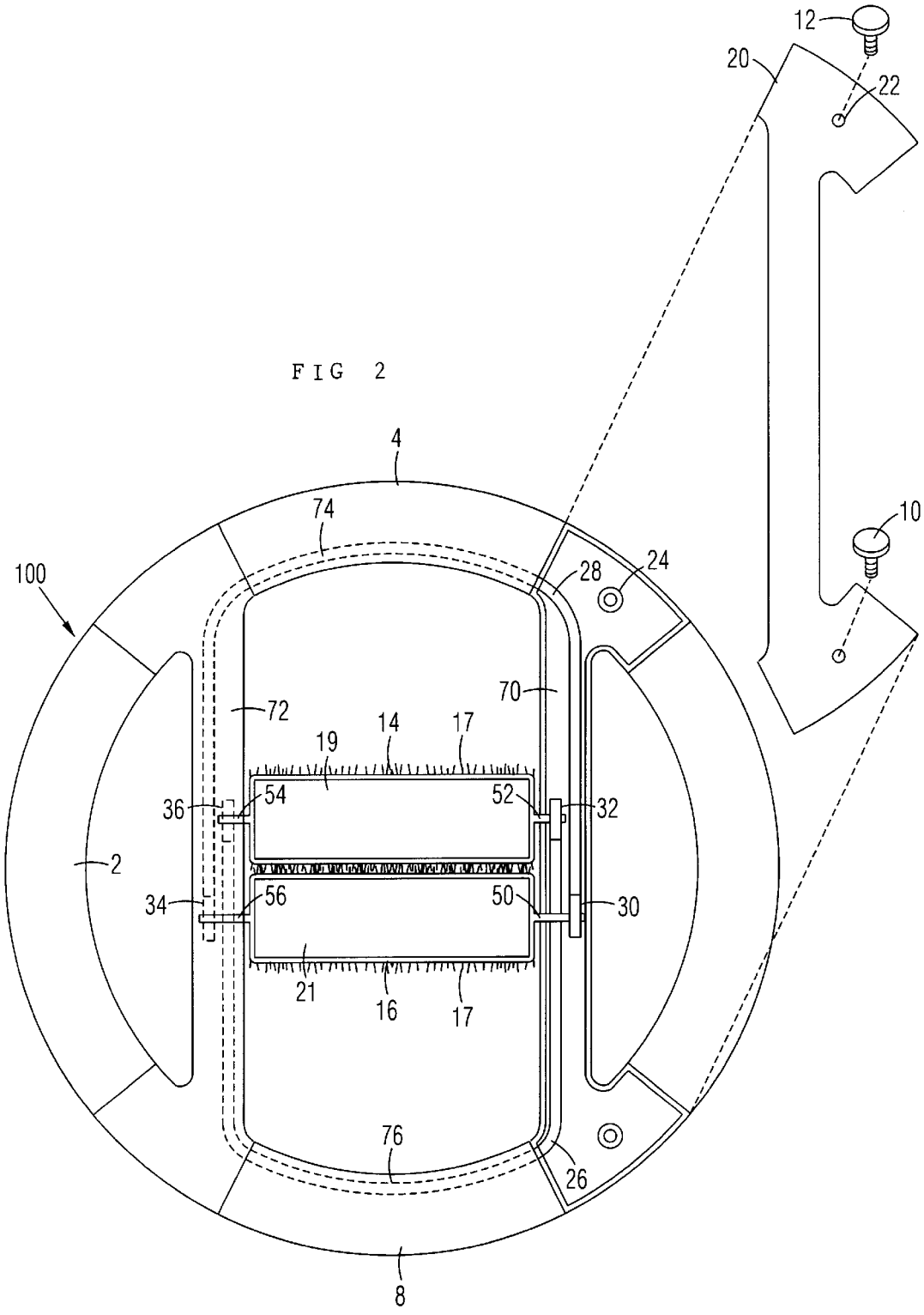
FIG. 2 is a plan view of the hand held massager of the present invention with a top cover removed.
Figure 3:
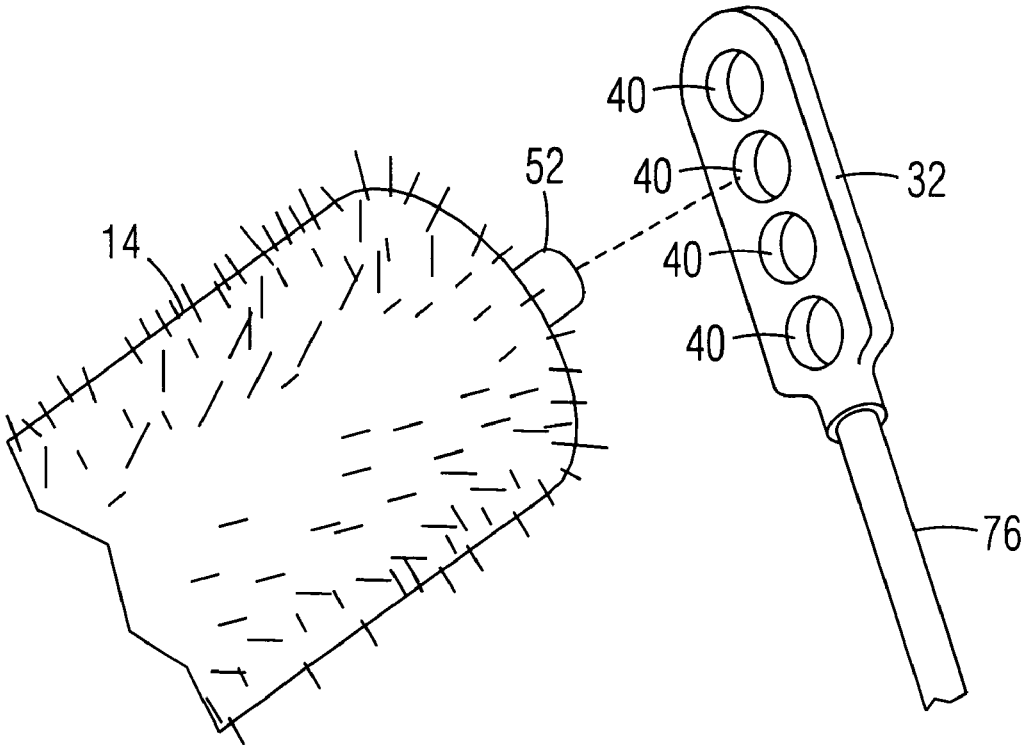
FIG. 3 is a perspective view of the adjusting mechanism of the present invention.
Figure 4:
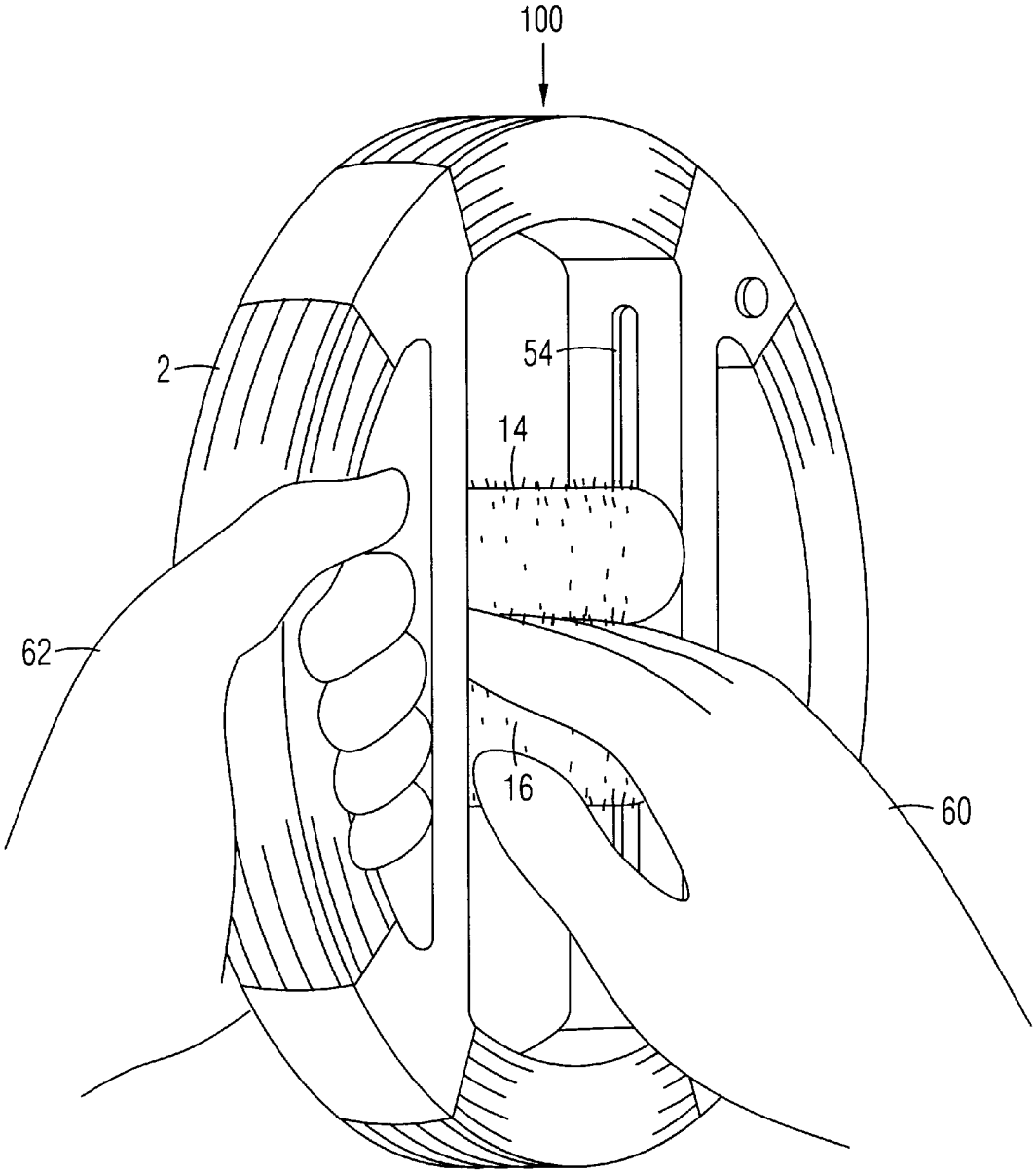
FIG. 4 is a perspective view of a user giving himself a hand massage.
Figure 5:
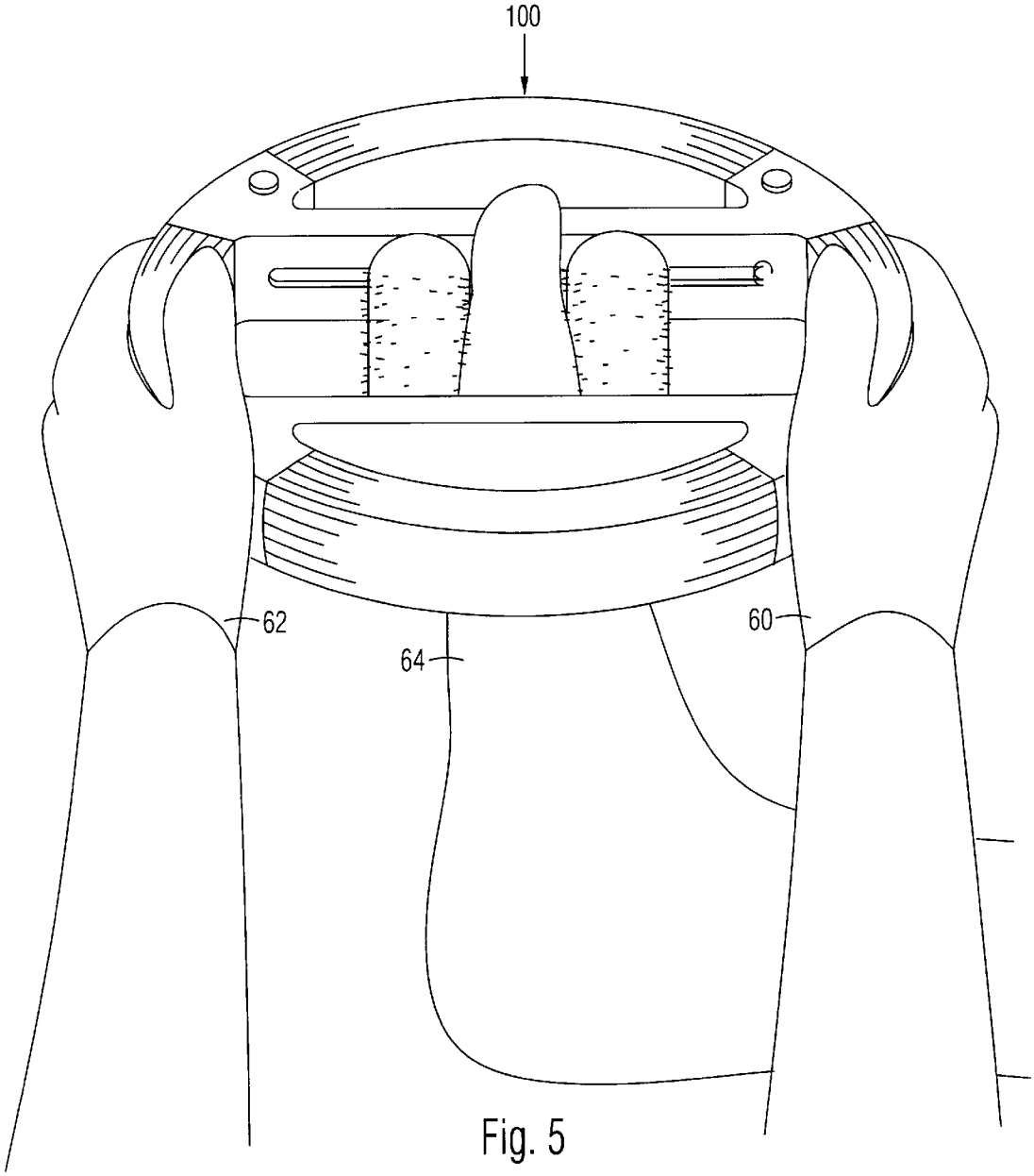
FIG. 5 is a perspective view of a user giving himself a foot massage.

Referring now to FIG. I, the plan view shows the hand held massage device 100 of the present invention. Two opposed rollers 14, 16 are located at the center portion of the massage device 100. The outer circular portion 2, 4, 6, 8 is a handle gripping area. FIG. 2 shows a plan view of the hand held massage device 100 of the present invention with the cover 20 removed exposing roller shafts 50, 52 as well as shaft couplers 30,32 and attached elastic cords 74, 76 all of which are residing in the hollow portion of track area 70. Elastic cords 74, 76 are also shown in dotted lines traveling around the opposing hollow track area 72 and hollow handle areas 4, 8. Elastic cord 74 travels 6' om shaft end SO to shaft end 56. Elastic cord 76 travels from shaft end 52 to shaft end 54. This arrangement creates an opposing spring action with respect to both rollers. Rollers 14, 16 are composed of a rigid portion 19, 21 and a resilient portion 17 which is composed of hundreds of plastic hairs similar to those found on plastic door mats currently available in the market. These hairs have sufficient resilience to create the effect of hundreds of tiny spring fingers which massage the skin and also increase blood flow in the area being massaged. The effect feels like a tingling sensation and is very invigorating. Rollers 14, 16 may be removed and replaced by other rollers of a similar size but with a different surface texture. For example the surface of the rollers may contain rubber bumps which would give a deeper massage. FIG. 3 shows a detail perspective view of elastic cord end 32 and the shaft 52 of roller end 14 ready to be inserted in one of a plurality of holes 40. Insertion in the lower most hole creates the least spring tension between rollers 14 and 16. Insertion in the upper most hole creates the most tension between rollers 14 and 16 thereby giving a more invigorating massage. The elastic cord end 32 is accessible by removing cover plate 20 as shown in FIG. 2. Cover plate 20 is removed by unscrewing thumb screws 10 and 12. After the tension adjustment is made the cover 20 is replaced.

The above description of the drawings therefore describe an improved hand held massaging device which can be used by a person to massage his or her hands, arms, feet and legs. Although the above drawings and description of the drawings reveal a preferred embodiment of the present invention, it is to be understood that there are other embodiments that may be employed while remaining within the spirit and scope of the present invention. For example, The elastic cords 74,76 may be replaced by extension or compression springs. The outer surface of the roller may consist of a plurality of rubber bumps or other raised configuration.

Therefore We claim:

1. A non-electric hand held massaging device, comprising:

a pair of rigid rollers each having a plurality of resilient raised portions radiating from a surface thereof, and each having shafts extending from opposite ends, said shafts are retained in a pair of tracks located in a pair of straight hollow frame portions adjacent to and perpendicular to said rollers, said frame portions are connected at each end to a hollow circular handle structure, said rollers are forced in close proximity to each other by elastic cords attached to the ends of each said roller shaft, said elastic cords are located in said track and said handle, said frame portions and said circular handle portion having a removable cover for accessing said elastic cords and said rollers.

2. A non-electric hand held massaging device, comprising:

a pair of rigid rollers each having a plurality of resilient raised portions radiating from a surface thereof, and said rigid rollers each having shafts extending from opposite ends, said shafts are retained in a pair of tracks located in a pair of straight hollow frame portions adjacent to and perpendicular to said rollers, said frame portions are connected at each end to a hollow circular handle structure, said rollers are forced in close proximity to each other by elastic cords attached to the ends of each said roller shaft, said elastic cords are located in said track and said handle, opposite ends of each said elastic cords are terminated in a rigid member having a plurality of shaft retaining holes providing tension settings for said elastic cord.

* * * * *